US012378787B2

(12) United States Patent
Loi

(10) Patent No.: US 12,378,787 B2
(45) Date of Patent: Aug. 5, 2025

(54) INTEGRATED STRUCTURAL AND ARCHITECTURAL FACADE LEVEL-BY-LEVEL CONSTRUCTION SYSTEM

(71) Applicant: Building Modern Pte. Ltd., Singapore (SG)

(72) Inventor: Teck Han Loi, Singapore (SG)

(73) Assignee: Building Modern Pte. Ltd., Singapore (SG)

( * ) Notice: Subject to any disclaimer, the term of this patent is extended or adjusted under 35 U.S.C. 154(b) by 977 days.

(21) Appl. No.: 16/962,472

(22) PCT Filed: Jan. 18, 2019

(86) PCT No.: PCT/SG2019/050030

§ 371 (c)(1),
(2) Date: Jul. 15, 2020

(87) PCT Pub. No.: WO2019/143298

PCT Pub. Date: Jul. 25, 2019

(65) Prior Publication Data

US 2021/0071434 A1 Mar. 11, 2021

(30) Foreign Application Priority Data

Jan. 18, 2018 (SG) ..... 10201800475R

(51) Int. Cl.
*E04B 1/346* (2006.01)
*E04B 5/40* (2006.01)
(Continued)

(52) U.S. Cl.
CPC ..... *E04G 21/3247* (2013.01); *E04B 5/40* (2013.01); *E04G 3/28* (2013.01); *E04G 21/3223* (2013.01); *E04G 5/14* (2013.01)

(58) Field of Classification Search
CPC ... E04G 21/3247; E04G 3/28; E04G 21/3223; E04G 5/14; E04B 5/40
See application file for complete search history.

(56) References Cited

U.S. PATENT DOCUMENTS 3,881,699 A * 5/1975 Nusbaum ..... E04G 21/3247 256/65.05
5,161,641 A * 11/1992 Nusbaum ..... E04G 21/3223 182/138
(Continued)

FOREIGN PATENT DOCUMENTS

CN 1786385 A 6/2006
CN 107090968 A 8/2017
(Continued)

OTHER PUBLICATIONS

International Search Report of PCT/SG2019/050030, mailed Apr. 17, 2019.

*Primary Examiner* — Basil S Katcheves
(74) *Attorney, Agent, or Firm* — Collard & Roe, P.C.; William Collard

(57) ABSTRACT

Provided is a level-by-level construction methodology integrating architectural and structural work for use in the construction of a multi-level building utilizing a movable protection system that can be mounted to a multi-level building during its construction.

23 Claims, 6 Drawing Sheets

(51) Int. Cl.

| | |
|---|---|
| ***E04G 3/28*** | (2006.01) |
| ***E04G 21/32*** | (2006.01) |
| *E04G 5/14* | (2006.01) |

(56) References Cited

U.S. PATENT DOCUMENTS

| | | | | |
|---|---|---|---|---|
| 9,033,106 | B2 * | 5/2015 | Blinn | E04G 21/3233 182/138 |
| 9,260,258 | B1 * | 2/2016 | Leum | E06B 11/00 |
| 2004/0261339 | A1 * | 12/2004 | Horton | E04G 21/3223 52/169.9 |
| 2006/0144639 | A1 * | 7/2006 | Iacoviello, Jr. | E04G 3/28 182/82 |
| 2006/0180390 | A1 * | 8/2006 | Thaler | E04G 21/3223 182/45 |
| 2006/0180391 | A1 * | 8/2006 | Thomas | E04G 21/3223 182/45 |
| 2007/0094942 | A1 * | 5/2007 | Dougall | E04G 21/3247 52/64 |
| 2008/0135821 | A1 * | 6/2008 | Svedberg | E04G 21/3223 256/31 |
| 2009/0120718 | A1 * | 5/2009 | O'Gorman | E04G 21/3295 182/138 |
| 2011/0179744 | A1 * | 7/2011 | Smith | E04G 21/3219 33/645 |
| 2012/0017419 | A1 * | 1/2012 | Honein | E04G 3/28 182/222 |
| 2013/0001493 | A1 * | 1/2013 | Svedberg | E04G 21/3233 52/745.11 |
| 2014/0217345 | A1 * | 8/2014 | Stoffels | B60R 3/005 256/64 |
| 2014/0318891 | A1 * | 10/2014 | Crothers | E04G 5/067 182/113 |
| 2014/0360814 | A1 * | 12/2014 | Panseri | E04G 23/08 299/10 |
| 2015/0129359 | A1 * | 5/2015 | Urzelai Ezkibel | E04G 5/04 182/82 |
| 2015/0211242 | A1 * | 7/2015 | Rosati | E04G 21/26 414/800 |
| 2016/0362278 | A1 * | 12/2016 | Taylor | E04G 21/3247 |
| 2018/0127993 | A1 * | 5/2018 | Baca | E04G 5/14 |
| 2018/0266127 | A1 * | 9/2018 | Smith | E04G 21/3228 |
| 2018/0328054 | A1 * | 11/2018 | Black | E04G 5/045 |
| 2019/0127999 | A1 * | 5/2019 | Puchner | E04G 21/3247 |
| 2020/0240155 | A1 * | 7/2020 | Eroglu | E04G 11/483 |
| 2021/0032886 | A1 * | 2/2021 | Schmid | E04G 3/28 |
| 2021/0189759 | A1 * | 6/2021 | Rainville | E04G 21/3233 |

FOREIGN PATENT DOCUMENTS

| | | | |
|---|---|---|---|
| CN | 206625528 | U | 11/2017 |
| KR | 100944463 | B1 | 3/2010 |
| WO | 2014/125308 | A1 | 8/2014 |
| WO | 2017/197440 | A1 | 11/2017 |

* cited by examiner

INTEGRATED STRUCTURAL AND ARCHITECTURAL FACADE LEVEL-BY-LEVEL CONSTRUCTION SYSTEM

CROSS REFERENCE TO RELATED APPLICATIONS

This application is the National Stage of PCT/SG2019/050030 filed on Jan. 18, 2019, which claims priority under 35 U.S.C. § 119 of Singapore Application No. 10201800475R, filed on Jan. 18, 2018, the disclosure of which is incorporated by reference. The international application under PCT article 21(2) was published in English.

FIELD OF THE INVENTION

The present invention relates to building construction and in particular to methods and apparatus for constructing multi-level buildings.

The invention has been developed more particularly as a method for constructing multi-level residential apartment buildings and will be described predominantly in this context. However, it will be appreciated that the invention is not limited to this particular field of use, being potentially applicable in a wide variety of other building types including commercial or industrial facilities, bridges, towers, schools, hospitals, houses, office blocks and the like. While the invention has been developed particularly for use with multi-level building construction, it may also be adapted for use in construction of single-level buildings.

BACKGROUND OF THE INVENTION

Any discussion of the prior art throughout the specification should in no way be considered as an admission that such prior art is widely known or forms part of common general knowledge in the field.

Construction of multi-level buildings is typically achieved using methods such as system formwork for level-by-level construction of structural works in respect of columns, beams and slabs. This is followed by a staged system of construction in respect of the architectural works such as insertion of windows, external plastering works, external plumbing works etc. During the first stage the building is erected level-by-level using external scaffolding or other means of hoisting building materials, such as apertures for doors and windows, to the required height. To comply with relevant building regulations, for health and safety reasons, the exterior of the building must be screened with a protective material during this stage to prevent debris falling from the upper levels. This protective material is usually flexible in nature, such as netting.

The architectural works can only commence following structural completion of the predetermined number of levels. The architectural works are usually performed stage-by-stage involving the installation of internal walls, external windows, door frames and other architectural requirements. The next stage is completion of concealing and plastering works. Following this, weather proofing of the building is then achieved by installing door and window panels, as well as balcony railings.

The final stage involves installation of drywall, marble, external trellis, ceiling works and painting, as required.

This sequential approach to construction results in a slow overall process, as separate trades groups are required for each stage and must be coordinated along a critical planning path. This results in an inherently high risk to project timelines, as any delay in one operation will then postpone subsequent operations.

It is an object of the present invention to overcome or ameliorate at least one of the disadvantages of the prior art, or to provide a useful alternative. It is an object of the invention in at least one preferred form to provide a method of construction of a multi-level building by integrating construction of architectural works with the construction of structural works thereby completing traditionally sequential construction activities simultaneously on different building levels to improve the process efficiency.

SUMMARY OF THE INVENTION

According to a first aspect of the invention there is provided a method of constructing a multi-level building having a predetermined number of levels, the method including the steps of:

a) setting and monitoring time periods and work cycles for completion of construction and installation tasks on a level-by-level basis;
b) selecting sub-contractors and, for each selected contractor, performing the following steps to comply with the time periods and work cycles set in step (a):
   i. setting and monitoring time periods for obtaining measurements, plans and specifications of deliverables; and
   ii. setting and monitoring sub-contractor timetables for selecting and sourcing materials, fabrication, delivery and installation;
   iii. assignment of worker duties to coordinate with the sub-contractor timetables;
c) installing formwork for a set of two or more levels of the building;
d) releasably mounting a moveable protection system to the building, thereby to enclose at least part of the periphery of the set of two or more levels;
e) completion of critical tasks of construction and installation in regard to the external façade of the lowest enclosed level of the set within the time period set in step (a);
f) thereafter raising the moveable protection system by a height substantially corresponding to one level of the building to enclose the next level above the previous set of levels, thereby defining a new set of enclosed levels.
g) installing formwork for the next enclosed level above the highest level of the lower set of levels;
h) repeating steps (e), (f), and (g) until step (g) is completed for the predetermined number of levels;
i) completing construction and installation tasks in regard to at least the external façade of the remaining enclosed levels.

The following is a description of an example of time tables for construction of the different levels of a building. For example, for the installation of formwork at an uppermost level the number of days for completion would be approximately 13 days. In addition, in another process which can be conducted either simultaneously, concurrently, before or after the above describe process there can be the completion of a fixed external barrier, and preferably include completion of all internal and external construction and installation tasks (with reference to [0011 i) substantially around the lower enclosed level wherein the barrier includes an externally facing facade. This step can also be completed in approximately 13 days as well. While these two stages of development and their timelines are described, the invention is not limited to a particular embodiment and construction may for example be carried out on two, three, four, five or more levels simultaneously. in other embodiments, multiple adjacent levels may be completed simultaneously, and the protection system may accordingly be raised by a height substantially corresponding to one level of the building or the number of completed building levels.

Preferably the set of levels in step (c) includes four levels. Preferably the movable protection system encloses the whole of the periphery of the building.

Preferably, step (e) also includes the completion of all internal and external construction and installation tasks of the lowest enclosed level of the set within the time period set in step (a).

Preferably step (e) includes one or more of the sub-steps of completing:

i. external doors and windows;
ii. balcony railings;
iii. air-ledge railings;
iv. external plastering;
V. external trellis;
vi. external electrical works;
vii. external plumbing works; and
viii. external aluminium formwork.

Preferably, step (i) also includes the completion of all internal and external construction and installation tasks of the remaining enclosed levels.

According to a second aspect of the invention there is provided a method of constructing a multi-level building having a pre-determined number of levels, the method including the steps of:

a) releasably mounting a moveable protection system to the building thereby to enclose at least part of the periphery of two or more levels of the building;
b) installing formwork on the uppermost enclosed level;
c) completing a fixed external barrier substantially around the lowest enclosed level, wherein the barrier includes an externally facing façade;
d) thereafter raising the moveable protection system by a height substantially corresponding to one level of the building; and) repeating steps (b), (c) and (d) until step (b) has been completed for the predetermined number of levels.

It will be appreciated that construction of the building occurs on a level-by-level basis rather than the conventional stage-by-stage construction method.

According to third aspect of the present invention there is provided a moveable protection system for use in constructing a multi-level building, the moveable protection system including:

means for releasably mounting the protection system to the building;
at least one protective screen for enclosing at least part of the periphery of two or more levels of the building;
means for raising the protection system with respect to the building.

In at least one embodiment, the building is a multi-level residential apartment building. However, it should be understood that the term "building" and the like are intended to be inclusive of alternative forms of civil engineering structures, other embodiments including commercial or industrial facilities, bridges, towers, schools, hospitals, houses or office blocks whether in single or multi-level configuration.

In some embodiments, the protection system is custom-made for each building. In other embodiments the protection system may be modular and adaptable to various building types and shapes.

In some embodiments, the moveable protection system includes at least one protective screen for enclosing at least part of the periphery of the building levels. Preferably, a plurality of screens are connected together to form a substantially gap-free enclosure. Preferably the screen height is at least equal to the floor-to-ceiling height of an enclosed level.

Preferably, the protective screens are multi-perforate. In other embodiments, the screens may be solid, wire-frame, mesh or netting. In some embodiments, the screens are made from aluminium sheet, however, it should be appreciated that alternative materials may be used including sheets, panels or wire of metals, polymers, mesh, wood or composite materials, which may be translucent or opaque. Preferably the screens are substantially impermeable to wind.

In embodiments employing perforated panel protective screens, an additional layer of netting screening is optionally attachable to the protection system. Preferably the netting screening is attachable external to the perforated panels.

In some embodiments, the protection system includes shoes for substantially closing a gap between the protective screen and the building. Preferably the shoes are in the form of flip-down panels.

Preferably the method includes an additional step after step (a) of accessing a materials delivery system from an enclosed level of the building through the movable protection system. Preferably the materials delivery system is a materials platform.

Preferably, the materials delivery system is separated from the protection system prior to step (c) to facilitate raising of the protection system. In other embodiments, the protection system may be moveable with the materials delivery system attached. In such embodiments, the materials delivery system may be repositioned after raising or lowering of the protection system.

Preferably the means for raising and lowering the protection system is a hydraulic system. In other embodiments, the protection system is raised or lowered using a crane.

Preferably, the protection system includes at least one openable section for facilitating access to a materials delivery system. Preferably, the materials delivery system is inserted through the openable section. Advantageously, this allows the delivery of building material specific to the stage of construction being carried out on each level.

In one embodiment the openable section is preferably a hinged screen. However, it should be appreciated that the section may be in a different form and open in various other ways including sliding rolling or retracting.

In some embodiments, at least one materials delivery systems is connectable to the protection system. Advantageously, this allows a materials delivery system to be attached at any location along the side of the building In other embodiments the materials delivery system may be connectable to the building. In still further embodiments, the materials may be delivered by crane or other lifting apparatus.

In some embodiments, the method includes the use of at least one crane. Preferably, a crane is positioned on the top level of the building. The crane preferably has a moveable arm. The arm preferably has sufficient length to reach all sides of the building. Advantageously, this allows construction materials to be lifted from the ground to the level currently being worked on from any side of the building. In other embodiments, one or more cranes may be operated from any one or more of ground level, from an intermediate building level, from adjacent buildings or from specially constructed scaffolding or crane towers.

Preferably, in step (c) of the method according to the second aspect, the fixed external barrier may take the form of any desired external wall system or part thereof, such as an infill wall, curtain wall, external façade, or the like. The presence of the fixed external barrier provides a safety barrier allowing the construction of further structural and architectural features to continue on a level without the moveable protection system enclosing that level.

In some embodiments, the protection system includes a supporting surface for bearing the weight of a worker. Preferably, the supporting surface is configured to support at least three workers. Preferably the supporting surface is in the form of weight-bearing flooring. In other embodiments, supporting surfaces may be attached to the protection system or to the building structure. In other embodiments, workers may gain access to the building levels using an elevated work platform.

In some embodiments, the protection system includes an aperture for accommodating passage of a passenger lift.

It will be understood that the protection system may be mounted to the building to enclose more than two levels. In one preferred embodiment, there is provided a system enclosing four adjacent levels. In this embodiment, step (b) of the method is conducted on the uppermost level, step (c) is conducted on the lowest level, and intermediate construction steps are carried out on the levels in between. It should be appreciated, however, that the invention is not limited to this particular embodiment and construction may, for example, be carried out on two, three, four, five or more levels simultaneously. In other embodiments, multiple adjacent levels may be completed simultaneously, and the protection system may accordingly be raised as set out in step (d) by a height substantially corresponding to the number of completed building levels.

According to one embodiment, the cycle time for achieving completion of each level is within the range of 8 to 15 days. However, it will be appreciated that the cycle time is not limited to this range, and may include shorter or longer time periods.

According to a fourth aspect of the invention there is provided a method of constructing a multi-level building having a pre-determined number of levels, the method including the steps of:

a) releasably mounting a moveable protection system for the building thereby to enclose at least part of the periphery of two or more levels of the building;
b) installing formwork on the uppermost enclosed level;
c) completing a fixed external barrier substantially around the lowest enclosed level, wherein the barrier includes an externally facing façade;
d) thereafter raising the moveable protection system by a height substantially corresponding to one level of the building; and
e) repeating steps (b), (c) and (d) until step (b) has been completed for the predetermined number of levels.

According to a fifth aspect of the invention, there is provided a construction planning method, including the steps of setting dates associated with:

a) selecting sub-contractors, including:
   i. setting time periods for obtaining measurements, plans and specifications of deliverables; and
   ii. setting sub-contractor timetables for selecting and sourcing materials, fabrication, delivery and installation;
b) starting and completing each cycle of construction;
c) assignment of worker duties to coordinate with the sub-contractor timetables;
d) sequencing construction steps to coordinate sub-contractor activities; and
e) carrying out the method according to the second aspect of the invention.

In a preferred embodiment, the dates are set in a project task schedule. Preferably the project task schedule includes substantially all tasks required for project completion. Preferably, the tasks are grouped within the project task schedule into categories according to trade discipline. In some embodiments, the categories may include but are not limited to main building works, architectural works, mechanical and/or electrical works and external works.

Preferably, a core project team is established prior to creating the project task schedule. Preferably, the core project team includes the roles of project engineer, project architect, mechanical engineer, electrical engineer and draughtsman.

Preferably, selection of sub-contractors in step (a) includes award of sub-contracts. Preferably award of sub-contracts occurs within a predetermined period of time from a main building contract award date. Preferably the predetermined period is 3 months. Preferably the project task schedule is communicated to substantially all sub-contractors.

Preferably, terms of the awarded contracts include clauses stipulating strict adherence to the dates set in steps (a) (i) and (a) (ii). Preferably the contract terms include penalties for failure to meet the set dates.

Preferably the length of each stage of construction in step (b) corresponds to the cycle time for achieving completion of each level. Preferably the cycle time is within the range of 8 to 15 days. More preferably, the cycle time is 10 days.

Preferably, materials are delivered in sets. Preferably, each set includes all materials required for construction of one floor. Preferably, the materials delivery dates are set in advance of each construction stage by at least the cycle time. Preferably the materials are delivered with shielding to protect the materials from damage for the duration of construction.

In some embodiments, the project task schedule includes a critical task schedule, including substantially all tasks requiring access to the building façade via the movable protection system. Preferably completion of each stage of construction in step (b) includes completion of all critical tasks for the lowest enclosed level. The critical tasks may include, but are not limited to, completion of: external doors and windows, balcony railings, air-ledge railings, plastering, external trellis, external electrical works, external plumbing works and aluminium formwork.

Preferably the movable protection system is the only means of external access to the building façade for the duration of the project. Advantageously, this substantially eliminates the need for staging or scaffolding, thereby reducing safety hazards.

Preferably step (d) includes setting milestones for each construction step in the project task schedule. Preferably each construction step is allocated to at least one worker or sub-contractor. Preferably, the construction steps are sequenced according to an order of dependency of execution.

Preferably, the start of steps allocated to internal architectural, mechanical and electrical sub-contractors substantially coincide with commencement of structural works on the fourth level of the building.

Preferably sample demonstrations are carried out substantially in advance of construction activities.

According to a sixth aspect of the present invention there is provided a moveable protection system according to the third aspect of the invention for use in the method according to the first, second, fourth or fifth aspects of the invention.

It will be appreciated by those skilled in the art that use of the level-by-level construction and planning method and moveable protection system advantageously results in improvements to safety, a cleaner working environment, reduced health hazards, increased efficiencies and faster completion of the building construction project.

BRIEF DESCRIPTION OF THE DRAWINGS

A preferred embodiment of the invention will now be described, by way of example only, with reference to the accompanying drawing in which.

PREFERRED EMBODIMENT OF THE INVENTION

Figure 1:
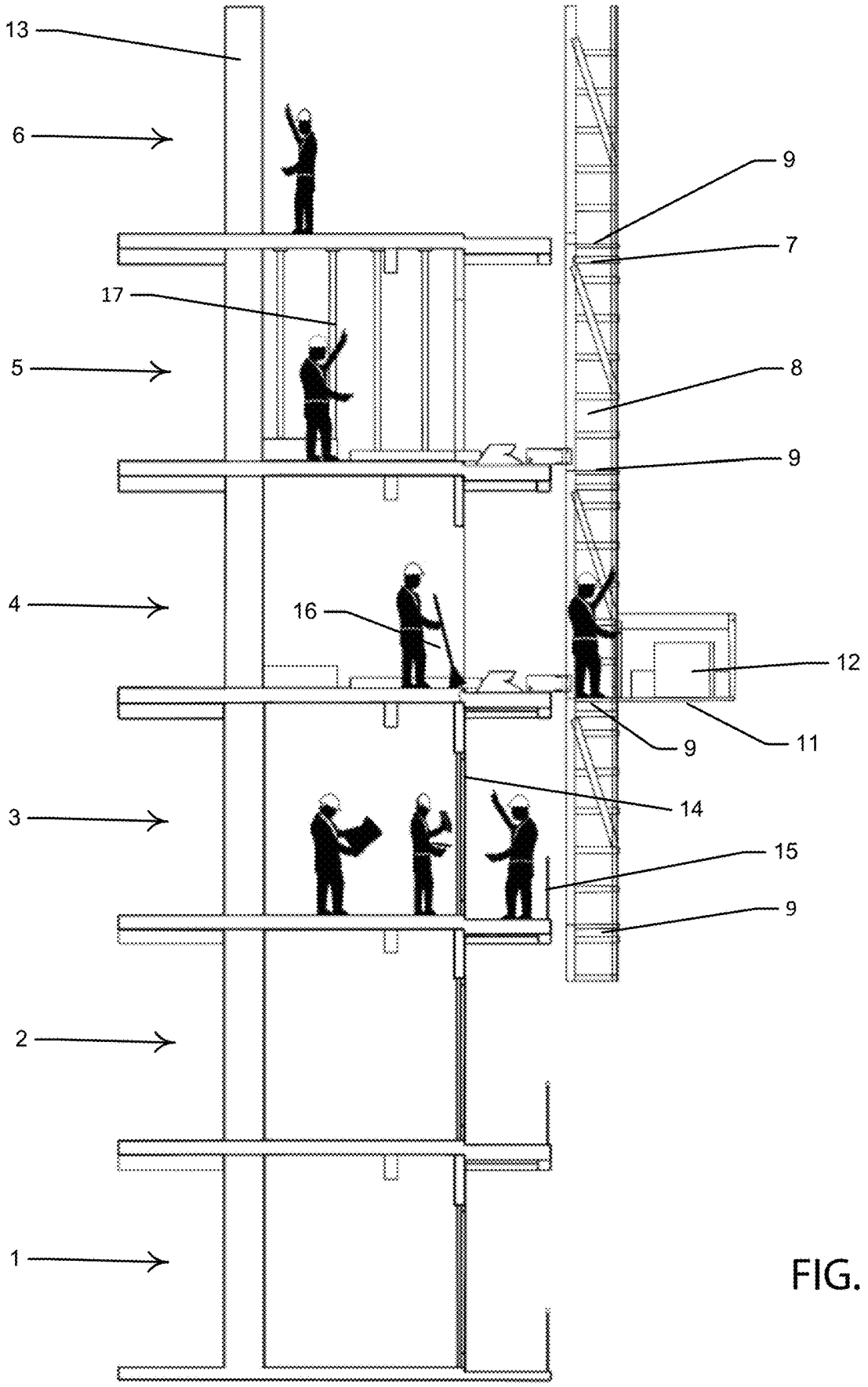
FIG. 1 is a schematic representation of a multi-level building under construction according to the invention.

Referring to FIG. 1, a multi-level building having a pre-determined number of levels is under construction using a level-by-level construction method. At the stage of construction illustrated, the building includes a first level 1, a second level 2, a third level 3, a fourth level 4, a fifth level 5 and a sixth level 6. The first and second levels have been completed. Construction activities are taking place on the third, fourth, fifth and sixth levels. For further reference see also FIGS. 2-6.

As shown, a moveable protection system 7 has been mounted to the exterior of the building, thereby to enclose at least part of the periphery of the four levels 3, 4, 5, 6 of the building on which construction is taking place. The protection system 7 includes a connected plurality of perforated aluminium protective screens 8, and supporting surfaces 9 aligned with each level of the building for supporting the weight of two to three men 10 simultaneously. The protection system also includes an aperture for accommodating passage of a passenger lift.

A materials delivery platform 11 can be inserted through the protection system 7 through an openable panel. The platform may be connected to the protection system or, alternatively, to the building. Construction materials 12 are delivered to the materials platform 11, via a crane on the building site or via another suitable method. One option may be to use a crane mounted on the building which has a moveable arm having sufficient length to reach all sides of the building. This allows construction materials 12 to be lifted from the ground to the level currently being worked on from any side of the building.

With the protection system is place to enclose levels three to six inclusive, formwork 13 is installed on the uppermost enclosed level, level six 6. Simultaneously, a fixed external barrier forming an external wall system is installed around the lowest enclosed level, level three 3. Dependent upon the construction method followed, this external wall system may include an infill wall, curtain wall, external façade or the like. It may also be in the form of a window frame 14, balcony railing 15, air-conditioning ledge and screens. This external wall provides a sufficient safety barrier to allow work to continue on the level without the protection system 7 enclosing that level.

Intermediate construction activities, such as housekeeping 16 in preparation for finishing activities and installing support props 17 are simultaneously carried out on levels four 4 and five 5, respectively.

Once all activities requiring external access to the façade of the lowest enclosed level 3 are completed, the materials platform 11 may be withdrawn from the protection system 7 to facilitate raising of the protection system. Where the material platform is connected to the protection system, it may not be necessary to detach the platform. The moveable protection system 7 is raised by a height corresponding to one level of the building using an hydraulic system. Level four 4 then becomes the lowest level. A new uppermost level is defined on which construction of formwork can now begin.

The construction steps above are then repeated until formwork 13 has been installed for the pre-determined number of levels. All levels are then brought to completion in order to finish construction of the building.

The building construction is planned using a project task schedule. An example project task schedule is shown in the table below, in which "W" refers to project week and "M" refers to project month.

List of Elements

Figure 2:
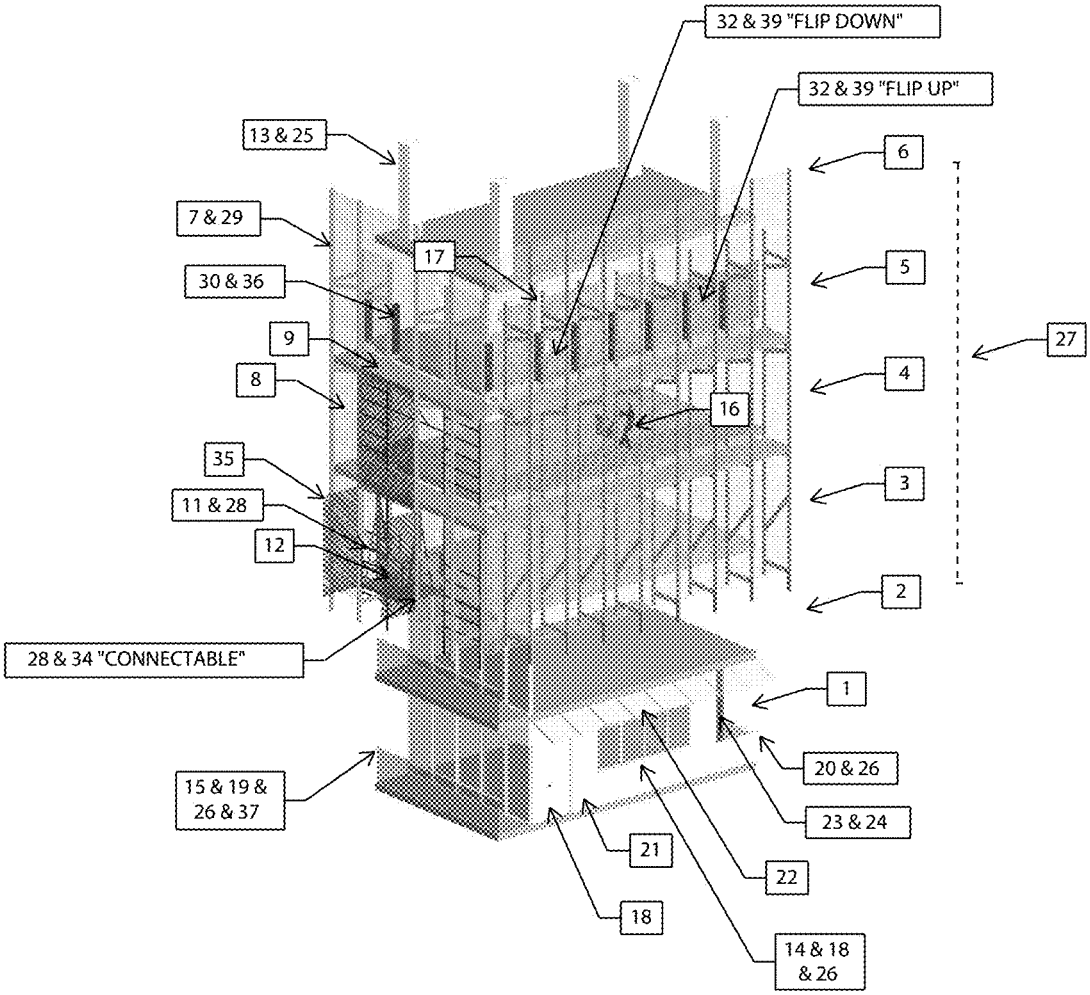
FIG. 2 is another schematic representation of a multi level building under construction according to the invention.
Figure 3:
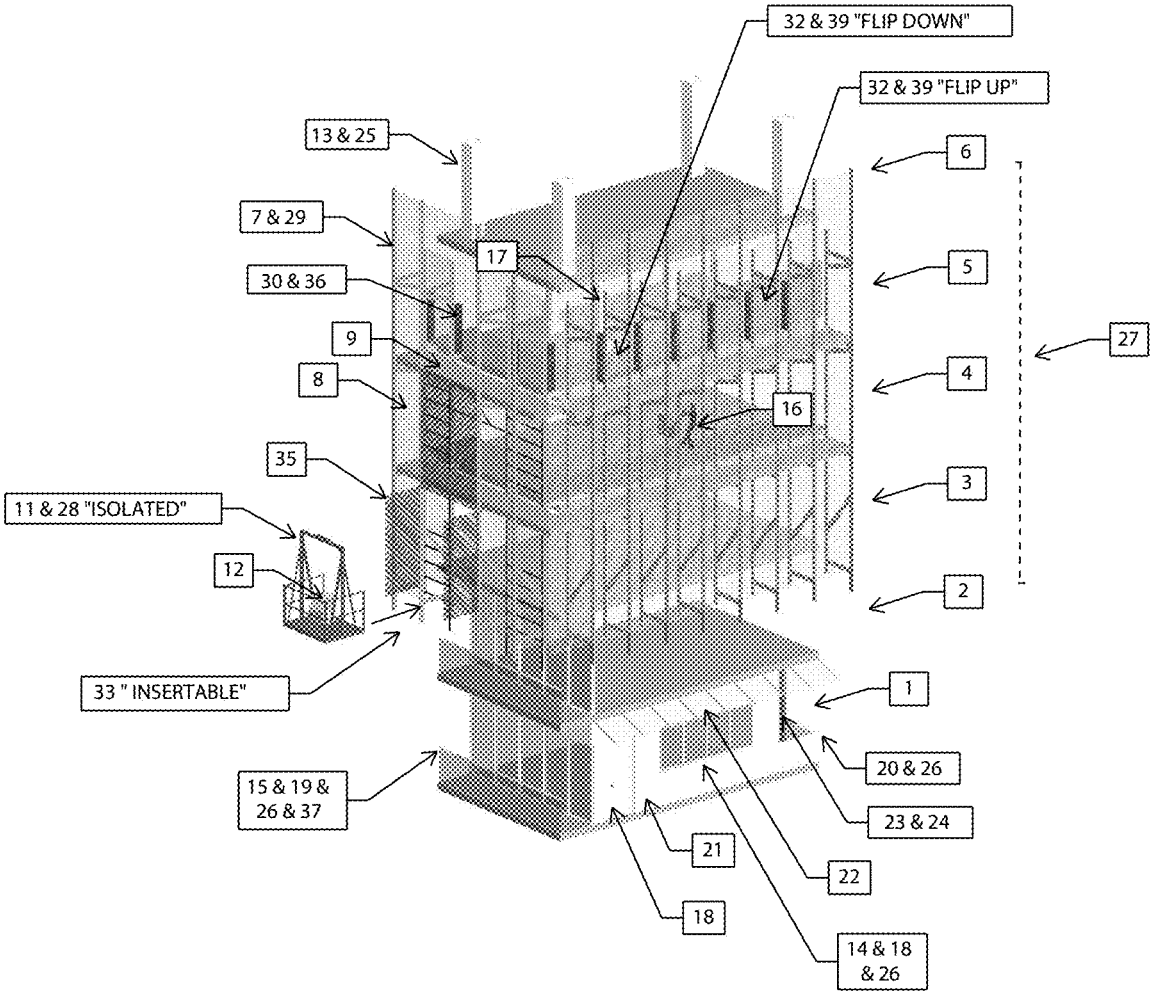
FIG. 3 is another schematic representation of a multi level building under construction according to the invention.
Figure 4:
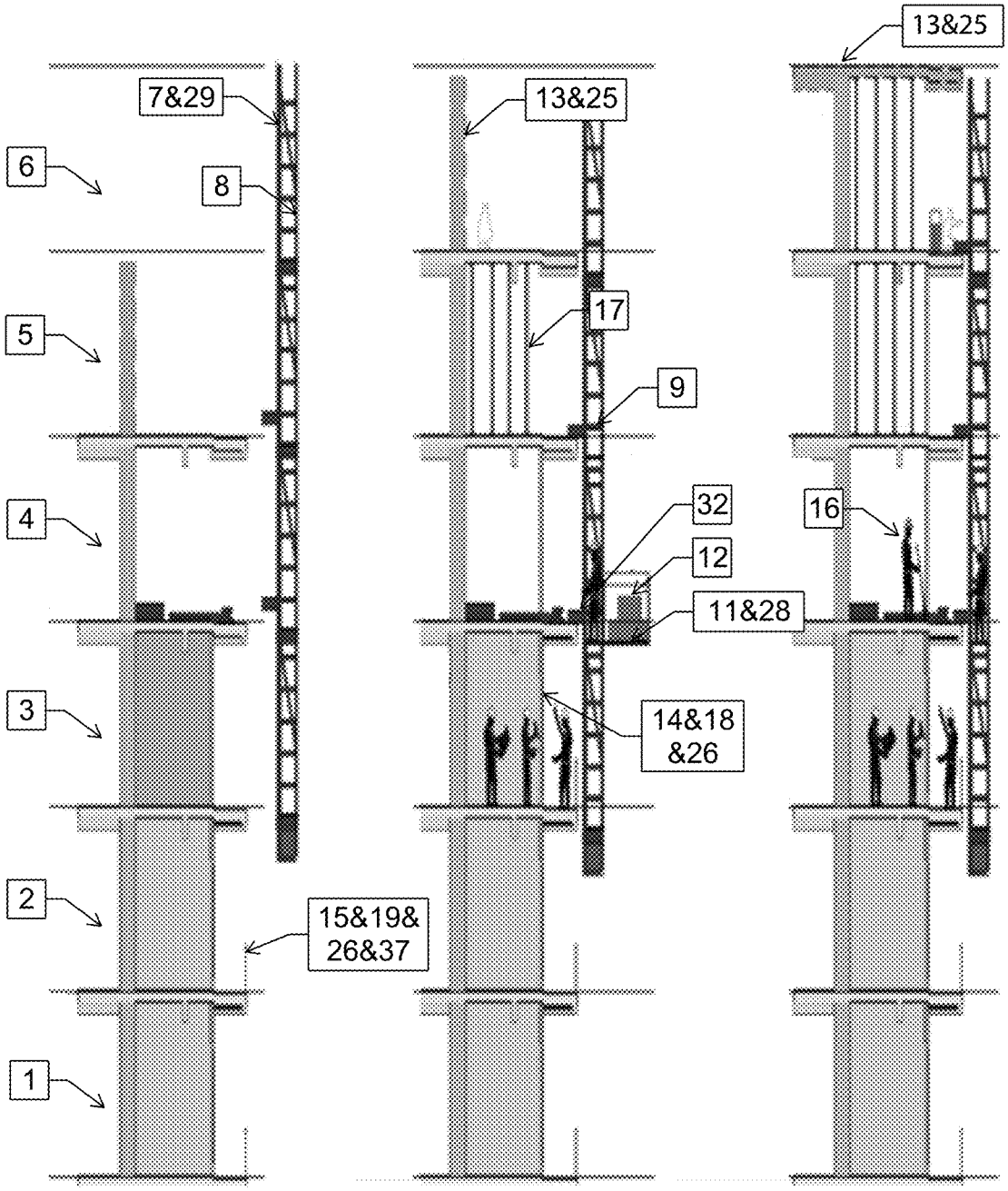
FIG. 4 is a view of the multi level building under construction.
Figure 5:
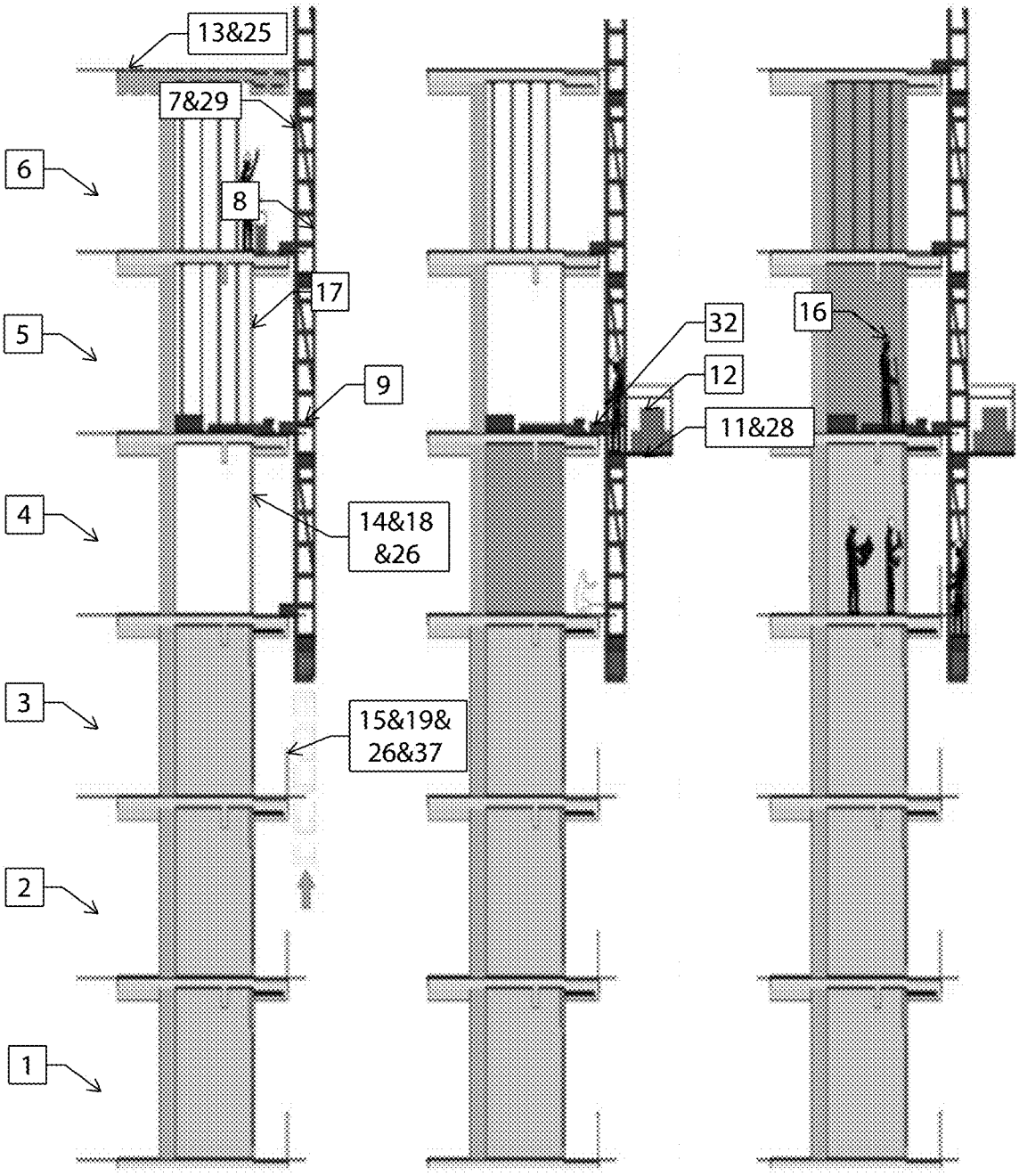
FIG. 5 is another view of the multi level building under construction.
Figure 6:
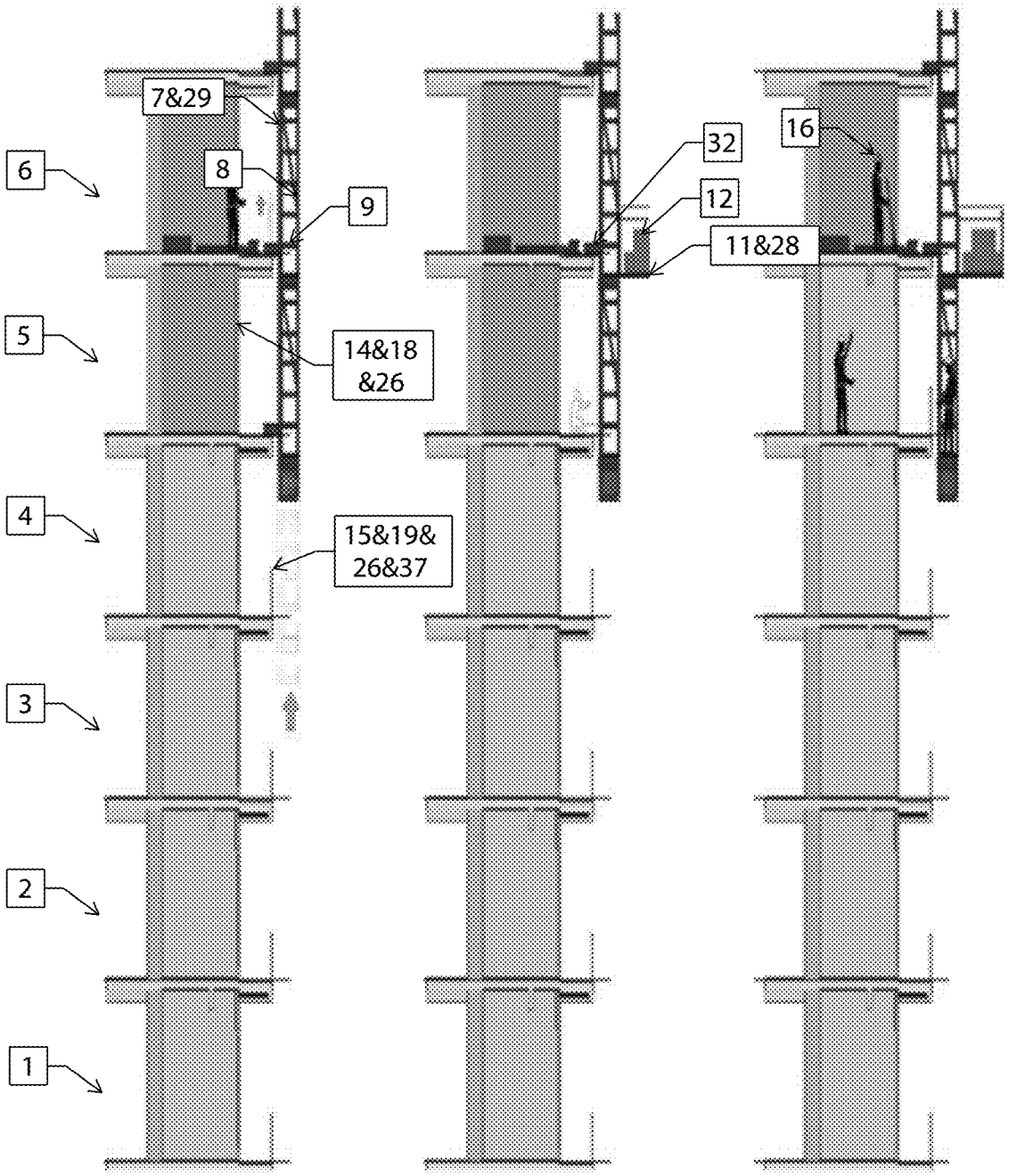
FIG. 6 is another view of the multi level building under construction.

1 first level
2 second level
3 third level
4 fourth level
5 fifth level
6 sixth level
7 moveable protection system
8 perforated aluminium protective screens
9 supporting surfaces
10 level of building
11 materials delivery platform
12 construction materials
13 formwork
14 window frame
15 balcony railing
16 housekeeping
17 support props
18 external doors and windows
19 balcony railings
20 air-ledge railings
21 external plastering
22 external trellis
23 external electrical works
24 external plumbing words
25 aluminium formwork
26 fixed external barrier
27 predetermined number of levels
28 materials delivery system
29 moveable protection system
30 device for raising the moveable protection system
31 [not represented in FIG. 1-3]
32 shoes
33 materials delivery system insertable through the openable section
34 materials delivery system is connectable to the moveable protection system
35 openable section is a hinged screen
36 hydraulic device for raising moveable protection system
37 safety barrier
38 passenger lift
39 shoes in the form of flip-down panels

| ProjectXYZ | | | | | |
|---|---|---|---|---|---|
| | | SITE POSSESSION = dd.mm.yyyy Qs's reply | | W1 = | |
| | | | Target | DD.MM.YYYY | |
| Title Project Task Schedule | | Action By | Award Date | Date | |
| Item | Description | Office | Site | Awarded | Remarks |
| | A PRELIMINARIES | | | | |
| 1.1 | Project Signboard | QS | W1 | | LETTER OF AWARD TO BE ISSUED |
| 1.2 | Insurance | QS | W2 | | WITHIN 2 WEEKS FROM LETTER OF AWARD |
| 1.3 | Performance Bond | QS | W2 | | WITHIN 2 WEEKS FROM LETTER OF AWARD |
| 1.4 | Pre & Post Condition Survey/Loss Adjuster | QS | W1 | | |
| 1.4 | Land Survey & Setting-out | QS | W4 | | |
| 1.5 | Cable Detection | QS | W1 | | |
| 1.7 | Resident Technical Officer | QS | W6 | | |
| 1.8 | Noise Meter | PURCHASER | W6 | | |
| 1.9 | Electrical Works and Temporary Power Supply Connection | QS | W3 | | |
| 2.0 | Plumbing & Sanitary Works and Temporary Water Supply Connection | QS | W3 | | |
| 2.1 | Design &Temporary Work PE Services | QS | W3 | | |
| 2.2 | Portable Toilet | Purchaser | W1 | | |
| 2.3 | | | W1 | | |
| 2.4 | Ground Instrumentation And Monitoring Works | QS | W6 | | |
| 2.5 | Pest Control | QS | W1 | | |
| 2.6 | Material Testing | QS | W8 | | |
| 2.7 | Scaffolding | PM/QS | M5 | | |
| 2.8 | Tower Crane Rental | Purchaser | M3 | | |
| 2.9 | CCTV Monitoring System for Construction Activities | QS | M3 | | |
| 3.0 | Pre & Post Con CCTV Survey on Existing Sewer | QS | W3 | | |
| 3.1 | Safety Audit/ConSASS | Safety | M3 | | |
| 3.2 | Site Hoarding & Gate & Sticker | Purchaser | W1 | | |
| 3.3 | | | | | |
| 3.4 | Noise Barrier Hoarding | Safety/ Purchaser/QS | W2 | | |
| 3.5 | Site Office (2 sty containers ) | PM/Purchaser | W2 | | FROM PEC49 |
| 3.6 | Workers Dormitory | PM/Purchaser | W4 | | |
| 3.7 | ERSS Temporary Works | | | | |
| 3.8 | Continuous Bored Pile | PM/QS | W4 | | |
| 3.9 | Earth Retaining Soil System Sheet Piling & Strutting | PM/QS | W4 | | |
| 4.0 | | | | | |
| 4.1 | Earth Control Measure | | | | |
| 4.2 | Earth Control Measure Tank ( QECP to design to suit site requirement ) | Safety | W2 | | |
| 4.3 | TSS & CCTV Monitoring System | QS | W2 | | |
| | B CRITICAL TASK SCHEDULE | | | | |
| 1.0 | Perimeter Moving Screen | QS | W10 | | |
| 2.0 | Prefabricated Bathroom Unit | QS | W10 | | |
| 3.0 | Design/Supply and delivery Alum Formwork | QS | W10 | | |
| 4.0 | Wet Trade - Labour - Masonry, Plastering, Tiling | QS | W10 | | |
| 5.0 | Curtain Wall | QS | W3 | | |
| 6.0 | Alum Door/Window glazings | QS | W3 | | |
| 7..0 | Glass Railing | QS | W3 | | |
| 8.0 | Alum Railing | QS | W3 | | |
| 9.0 | Steel galvanised Railing | QS | W3 | | |
| 10.0 | Structural form works system | QS | W6 | | |
| 11.0 | Air-con ledge | QS | W5 | | |
| | C MAIN BUILDING WORKS | | | | |
| 2 | Anti-termite/Soil Treatment | QS | W8 | | |
| 3.0 | Earth Works | | | | |
| | Structural Works | QS | W10 | | ISSUE DRAWINGS PRIOR TO |
| 0.1 | Perimeter Moving Screen | QS | W10 | | |
| 0.2 | Prebaricated bathroom unit | QS | W8 | | |
| 0.3 | Bored Pile works | | W8 | | |
| 0.4 | Precast Concrete Components | In-house | W8 | | |
| 0.5 | 3 in 1 Structural Works - Labour | In-house | W8 | | |

-continued

| ProjectXYZ | | | | | |
|---|---|---|---|---|---|
| | | SITE POSSESSION = dd.mm.yyyy Qs's reply | | W1 = | |
| | | | Target | DD.MM.YYYY | |
| Title Project Task Schedule | | Action By | Award Date | Date | |
| Item | Description | Office | Site | Awarded | Remarks |
| 0.6 | Design/Supply and delivery Alum Formwork | In-house | W8 | | |
| 0.7 | Power Float | Purchaser | W9 | | |
| 0.8 | Material supply - Reinforcement Bar/mesh | Purchaser | W9 | | |
| 0.9 | Material supply - Reinforcement Bar (Backup) | Purchaser | W9 | | |
| 1.0 | Material supply - Concrete | Purchaser | W9 | | |
| 1.1 | Material supply - Concrete (Backup) | Purchaser | W9 | | |
| 1.2 | Material supply - Aluminium Formwork | Purchaser | W9 | | |
| 1.3 | Material supply - Metal Formwork | Purchaser | W9 | | |
| 1.4 | Material supply - Ordinary portland cement | QS | W10 | | |
| 1.5 | Concrete Waterproofing Additive & ADMIXTURE | QS | W10 | | |
| 1.6 | Waterproofing Membrane & for Basement, E-Deck and Roof Garden | | | | |
| | D ARCHITECTURAL WORKS | | | | |
| 1.0 | Wet Trade - Labour - Masonry, Plastering, Tiling | Purchaser | W2 | | |
| 1.1 | Wet Trade - Material Supply - Mansonry | Purchaser | W2 | | |
| 1.2 | Wet Trade - Material Supply - Prepacked | QS | W2 | | |
| 1.3 | Wet Trade - Material Supply - Tiling | QS | W2 | | |
| 1.4 | Wet Trade - Material Supply - Granite | QS | W2 | | |
| 2.0 | Wet Trade - Material Supply - Lightweight Concrete Panel | QS | W3 | | |
| 2.1 | Kitchen Cabinets, Distribution Board Cabinet | QS | W3 | | |
| 2.2 | Wardrobes | QS | M8 | | |
| 2.3 | Fitting-out Works to Clubhouse and Main Lift Lobbies | QS | M8 | | |
| 2.4 | Softscape Works | QS | M8 | | |
| 2.5 | Playslide Equipment | QS | M8 | | |
| 2.6 | Gymnasium Equipment | QS | M8 | | |
| 2.7 | Outdoor Furniture | QS | M9 | | |
| 2.8 | Letter Box, Blast door, Hopper | QS | M9 | | |
| 2.9 | Cabinet & install vanity top | QS | M9 | | |
| 3.0 | Fire Doors, Metal, Timber Doors | QS | M9 | | |
| 3.1 | Pocket Door System | QS | M9 | | |
| 3.2 | Bicycle Rack | QS | W11 | | |
| 3.3 | Shower Screen | QS | W11 | | |
| 3.4 | Mirror | QS | W11 | | |
| 3.5 | Painting/Road Marking | QS | W11 | | |
| 3.6 | False Ceiling Work & Drywall Partition | QS | M10 | | |
| 3.7 | Signages | QS | M8 | | |
| 3.8 | Timber Works (timber deck & timber flooring) | QS | M8 | | |
| 3.9 | Roller Shutter | QS | M10 | | |
| 4.0 | Lightweight panel | QS | M10 | | |
| 4.1 | Wrought Iron | QS | M11 | | |
| 4.2 | Column Guard & Speed Breaker Hump | QS | M11 | | |
| 4.3 | Metal works | QS | M11 | | |
| 4.4 | Jacuzzi | QS | | | |
| | E MECHANICAL AND ELECTRICAL WORKS | | | | |
| 1.0 | Gas, Plumbing & Sanitary, Fire Hosereel, Dry Riser | QS | M3 | | |
| 2.0 | Minor Sewer & Diversion Works | QS | M3 | | |
| 3.0 | Electrical, Telephone & CATV Works | QS | M3 | | |
| 4.0 | Automatic Fire Sprinker & Alarm System | QS | M3 | | |
| 5.0 | Air Conditionining and Mechanical Ventilation System | QS | M3 | | |
| 6.0 | Swimming Pool | QS | M3 | | |
| 7.0 | Lift Installation System | QS | M3 | | |
| | F EXTERNAL WORKS | | | | |
| 1.0 | Drainage & Culvert Work | QS | M12 | | |
| 1.1 | External Road - Premix, Road Marking, Traffic Signages | QS | M12 | | |
| 1.2 | Structural Steel for Precinct (Linkway, Drop-off Porch, Precinct Pavilion, Shelter, Trellis & etc) | QS | M10 | | |

-continued

| ProjectXYZ | | | | | |
|---|---|---|---|---|---|
| | | SITE POSSESSION = dd.mm.yyyy Qs's reply | | W1 = | |
| | | | Target | DD.MM.YYYY | |
| Title Project Task Schedule | | Action By | Award Date | Date | |
| Item | Description | Office | Site | Awarded | Remarks |
| 1.3 | Metal Roofing/Trellis | QS | M10 | | |
| 1.4 | Landscape Works | QS | M12 | | |
| | Playground, Adult & Elderly Equipment and EDPM Flooring | QS | | | |

The invention claimed is:

1. A method of constructing a multi-level building having a predetermined number of levels by integrating construction of architectural works with the construction of a set of structural works thereby completing traditionally sequential construction activities simultaneously on different building levels, the method including the steps of:

a) setting and monitoring a first set of time periods and work cycles for completion of construction and installation a first set of work tasks on a level-by-level basis;

b) selecting sub-contractors and, for each selected contractor, performing the following steps to comply with the time periods set in step (a):

i. setting and monitoring a second set of time periods for obtaining measurements, plans and specifications of materials; and ii. setting and monitoring sub-contractor timetables for selecting and sourcing materials, fabrication, delivery and installation;

iii. assignment of a second set of work tasks to coordinate with the subcontractor timetables;

c) performing structural works comprising installing formwork for a set of two or more levels of the building;

d) releasably mounting a moveable protection system to the building, thereby to enclose at least part of a periphery or a surrounding of the set of two or more levels including an aperture configured for accommodating a passenger lift;

e) completing architectural works comprising all critical internal and external construction and installation steps of a lowest enclosed level of the set within the time period set in step (a);

f) thereafter raising the moveable protection system by a height substantially corresponding to one level of the building to enclose a next level above a previous set of levels, thereby defining a new set of enclosed levels, g) performing structural works comprising installing formwork for a next enclosed level above a highest level of a lower set of levels;

h) repeating steps (e), (f), and (g) until step (g) is completed for the predetermined number of levels;

i) completing construction and installation steps in regard to at least an external façade of the remaining enclosed levels.

2. The method according to claim 1 wherein the set of two or more levels in step (c) includes four levels.

3. The method according to claim 1 wherein the movable protection system encloses the whole of the periphery of the building.

4. A method of construction according to claim 1 wherein step (e) includes one or more substeps of completing:

i. external doors and windows;

ii . . . balcony railings;

iii. air-ledge railings;

iv. external plastering;

V. external trellis;

vi. external electrical works;

vii. external plumbing works; and viii. aluminium formwork.

5. The method according to claim 1 wherein step (e) includes integrating construction of architectural works with construction of structural works in step (g) in a simultaneous completion of traditionally sequential internal and external construction on different building levels that are enclosed.

6. A moveable protection system for use in constructing a multi-level building including:

means for releasably mounting the protection system to the building;

at least one protective screen for enclosing at least part of the periphery of two or more levels of the building that are under construction;

a supporting surface for bearing the weight of at least one worker;

top-hinged panels of screens openable to rest on a level of the building that is under construction in order to substantially close a gap between the protective screen and the building at an access location between the supporting surface and the level of the building that is under construction;

means for raising the protection system with respect to the building;

wherein the movable protection system is configured to be used to construct a multi-level building according to the method of claim 1.

7. The moveable protection system according to claim 6 wherein the platform for delivery of materials is insertable through an openable section.

8. The moveable protection system according to claim 6 wherein the platform for delivery of materials is connectable to the moveable protection system.

9. The moveable protection system according to claim 6 wherein an openable section is a hinged screen.

10. The moveable protection system according to claim 6 wherein the means for raising the protection system is a hydraulic device.

11. The moveable protection system according to claim 6 wherein the at least one protective screen is multi-perforate.

12. The moveable protection system according to claim 6 including a plurality of screens connected together to form a safety barrier.

13. The moveable protection system according to claim 6 including an aperture for accommodating a passenger lift.

14. The moveable protection system according to claim 6 wherein the top-hinged panels of screen may be opened out flat to rest on a level of the building that is under construction in order to substantially close a gap between the protective screen.

15. The method of constructing a multi-level building having a pre-determined number of levels, according to claim 1, the method further comprising the steps of:

j) releasably mounting a moveable protection system according to claim 6 to the building thereby to enclose at least part of the periphery of two or more levels of the building;

k) installing formwork on an uppermost enclosed level;

l) completing a fixed external barrier substantially around the lowest enclosed level, wherein the barrier includes an externally facing façade;

m) thereafter raising the moveable protection system by a height substantially corresponding to one level of the building; and n) repeating steps (b), (c) and (d) until step (b) has been completed for the predetermined number of levels.

16. A construction planning method, including the steps of setting dates associated with:

a) selecting sub-contractors including:

i. setting time periods for obtaining measurements, plans and specifications of deliverables; and ii. setting sub-contractor timetables for selecting and sourcing materials, fabrication, delivery and installation;

b) starting and completing each cycle of construction;

c) assignment of worker duties to coordinate with the sub-contractor timetables;

d) sequencing construction steps to coordinate sub-contractor activities; and e) carrying out the method according to claim 1.

17. A method of constructing a multi-level building having a predetermined number of levels by integrating construction of architectural works with the construction of a set of structural works thereby completing traditionally sequential construction activities simultaneously on different building levels, the method including the steps of:

a) releasably mounting a moveable protection system to the building thereby to enclose at least part of a periphery of two or more levels if of the building and then accessing a platform for delivery of materials from an enclosed level of the building through the movable protection system;

b) performing structural works comprising installing formwork on an uppermost enclosed level;

c) completing a fixed external barrier substantially around a lowest enclosed level, wherein the barrier includes an externally facing façade;

d) thereafter raising the moveable protection system by a height substantially corresponding to one level of the building and installing formwork on a new uppermost level enclosed by the moveable protection system;

e) completing a fixed external barrier substantially around a new lowest enclosed level after raising the moveable protection system in (d), wherein the barrier includes an externally facing façade; and continuing the process of raising the moveable protection system in (d) and completing structural works and architectural works comprising all critical internal and external construction and installation work tasks of the lowest enclosed level of the moveable protection system by a height substantially corresponding to one level of the building and installing formwork on the new uppermost level enclosed by the moveable protection system, completing a fixed external barrier substantially around the new lowest enclosed level after raising the moveable protection system, wherein the barrier includes an externally facing façade until the formwork has been installed for the predetermined number of levels.

18. The method according to claim 17 wherein a platform for delivery of materials is isolated from the protection system prior to step (c) to facilitate raising of the protection system.

19. The method according to claim 17 wherein step (a) includes connecting the platform for delivery of materials to the moveable protection system.

20. The method according to claim 19 wherein step (d) includes raising the moveable protection system with the platform for delivery of materials connected thereto.

21. The method according to claim 17 wherein step (d) utilizes a hydraulic device for raising the moveable protection system.

22. The method according-claim 17, wherein step (a) includes enclosing three or more levels of the building, and wherein the method includes an additional step (c1) performed between steps (a) and (d), step (c1) including performing intermediate construction activities on an at least one middle level of at least three levels.

23. The method according to claim 17, wherein a time required to install formwork to completion of all critical internal and external construction and installation steps of a level simultaneously is within the range of 8 to 15 days.

* * * * *